US005826857A

United States Patent [19]

Brack et al.

[11] Patent Number: 5,826,857

[45] Date of Patent: Oct. 27, 1998

[54] LIGHT VEHICLE SERVICE STAND

[76] Inventors: Billy M. Brack, 4312 Berkley Dr., Tampa, Fla. 33610; Roscoe L. Love, 1612 Sunnyhills Dr., Brandon, Fla. 33510

[21] Appl. No.: 810,298

[22] Filed: Mar. 3, 1997

[51] Int. Cl.[6] ..... B66F 3/00

[52] U.S. Cl. ..... 254/8 R; 254/94; 254/131

[58] Field of Search ..... 254/120, 131, 254/133, 134, 8 B, 8 R, 9 B, 9 R, 94, 134.3 R

[56] References Cited

U.S. PATENT DOCUMENTS

| | | | |
|---|---|---|---|
| 3,136,526 | 6/1964 | Wolf | 254/134 |
| 3,968,952 | 7/1976 | Newell | 254/134.3 R |
| 4,239,195 | 12/1980 | Oltman et al. | 269/16 |
| 5,232,203 | 8/1993 | Butts | 254/131 |
| 5,382,131 | 1/1995 | Werthmann | 254/131 |
| 5,618,030 | 4/1997 | Eggert | 254/131 |
| 5,678,804 | 10/1997 | Lintelman et al. | 254/131 |
| 5,713,557 | 2/1998 | Kang | 254/131 |

*Primary Examiner*—Robert C. Watson
*Attorney, Agent, or Firm*—Ronald E. Smith

[57] ABSTRACT

A commercial mower support stand includes a cradle at its top that is adapted to engage a lifting bar that is secured to the front or rear end of a lawn mower, golf cart, or other light vehicle. The cradle is supported by a plurality of upstanding rigid legs that are secured at their respective lowermost ends to a base plate. A pair of laterally spaced apart support legs support a forward end of the base plate and a pair of laterally spaced apart wheels support the rearward end of the base plate when the stand is in its upright position on a support surface. A tube mounted at a predetermined angle to the base plate slidingly receives an elongate leverage handle that is used to manipulate the stand as needed when lifting and lowering a preselected end of a light vehicle. The stand includes storage receptacles for the leverage handle, replacement mower blades, a lubrication gun, or other items and tools.

8 Claims, 5 Drawing Sheets

LIGHT VEHICLE SERVICE STAND

BACKGROUND OF THE INVENTION

1. Field of the Invention

This invention relates, generally, to devices that facilitate the servicing of commercial lawn mowers, golf carts, and similar light vehicles. More particularly, it relates to a device that lifts the front or back end of such vehicles and which carries certain parts needed during the servicing of such vehicles.

2. Description of the Prior Art

The blades of commercial lawn mowers require daily replacement. Moreover, commercial mowers, golf carts, and similar light vehicles need frequent lubrication and other maintenance procedures on the motor and transmission as well. However, such vehicles are bulky and thus lifting them to facilitate blade changing or to perform lubrication or other maintenance procedures is not easy.

A hydraulic lift of the type used to elevate automobiles could be employed, but such lifts are quite expensive to own, operate, and maintain. Moreover, it is not necessary to raise the entire vehicle off the ground in order to perform routine maintenance procedure such as blade-changing (for mowers), and the like; it is sufficient to merely lift the front end of the vehicle while leaving the rear wheels thereof in contact with a support surface. Similarly, lifting only the rearward end of the vehicle facilitates lubrication and other maintenance procedures on the motor and drive train. Thus, use of a hydraulic lift that raises both the front and rear wheels off the ground represents an expensive and unneeded solution to the problems associated with blade changing, lubrication, and other general maintenance.

However, since mowers, golf carts, and the like are mounted on wheels, they roll easily and thus defeat most casual attempts to simply lift one end thereof.

Some obvious methods that can be employed are simply too time-consuming. For example, jacking up the front or rear end of a mower or cart is a time-consuming process that begins with blocking the back or front wheels so that they cannot roll when the front or rear end is jacked up, respectively. The jacking process itself takes no short amount of time and must be repeated when the maintenance procedures have been completed and the vehicle is to be lowered. Jacks have also been known to fail or slip so avoiding their use is desireable.

Thus, it would be advantageous if a device for lifting the front or rear end of a light vehicle could be found that did not rely on jacks. It would be even more advantageous if such a device could also provide a means for holding a lubrication gun, lawn mower blades, or other tools or items needed when performing routine maintenance procedures.

However, in view of the art considered as a whole at the time the present invention was made, it was not obvious to those of ordinary skill in this art how the needed lifting device could be provided.

SUMMARY OF THE INVENTION

The longstanding but heretofore unfulfilled need for an apparatus that overcomes the limitations of the prior art is now met by a new, useful, and nonobvious invention. The present invention is a light vehicle service stand that includes a cradle means adapted to cradle a bar fixedly secured to a preselected (front or rear) end of a commercial lawn mower, golf cart, and the like. A base member is disposed in vertically spaced relation to the cradle means, and a first pair of rigid leg members are disposed in interconnecting relation between a first end of the cradle means and a first end of the base. A second pair of rigid leg members are disposed in interconnecting relation between a second end of the cradle means and a second end of the base.

The base has a forward end, a rearward end, and a pair of laterally spaced apart sides; an axle means is mounted to the rearward end of the base, and a wheel is rotatably mounted to each end of the axle.

The novel structure further includes an elongate handle for leveraging the service stand and a handle-engaging means mounted to the service stand at a preselected location near the lowermost end thereof. The front or rear end of a commercial mower, golf cart, or the like is lifted by first engaging the bar with the cradle means, with the wheels of the service stand in rotatable engagement with the support surface; the base of the service stand is disposed in nearly vertical position relative to the support surface when the cradle means so engages the bar. Next, the base is brought into parallel relation to the support surface by manually pulling down on a free end of the elongate handle while the elongate handle is engaged to the handle-engaging means; this action lifts the front or rear wheels of the vehicle.

In this way, no jack is needed and there is no need to place blocks behind the front or rear wheels of the vehicle when lifting the rear or front end of the vehicle, respectively.

It is a primary object of this invention to provide a device that reliably lifts the front or rear end of a commercial mower or other light vehicle to facilitate blade changing, if applicable, lubrication, and other maintenance procedures.

Another object is to provide such a device that also carries blades, a lubrication gun, and other miscellaneous items of use during such maintenance procedures.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
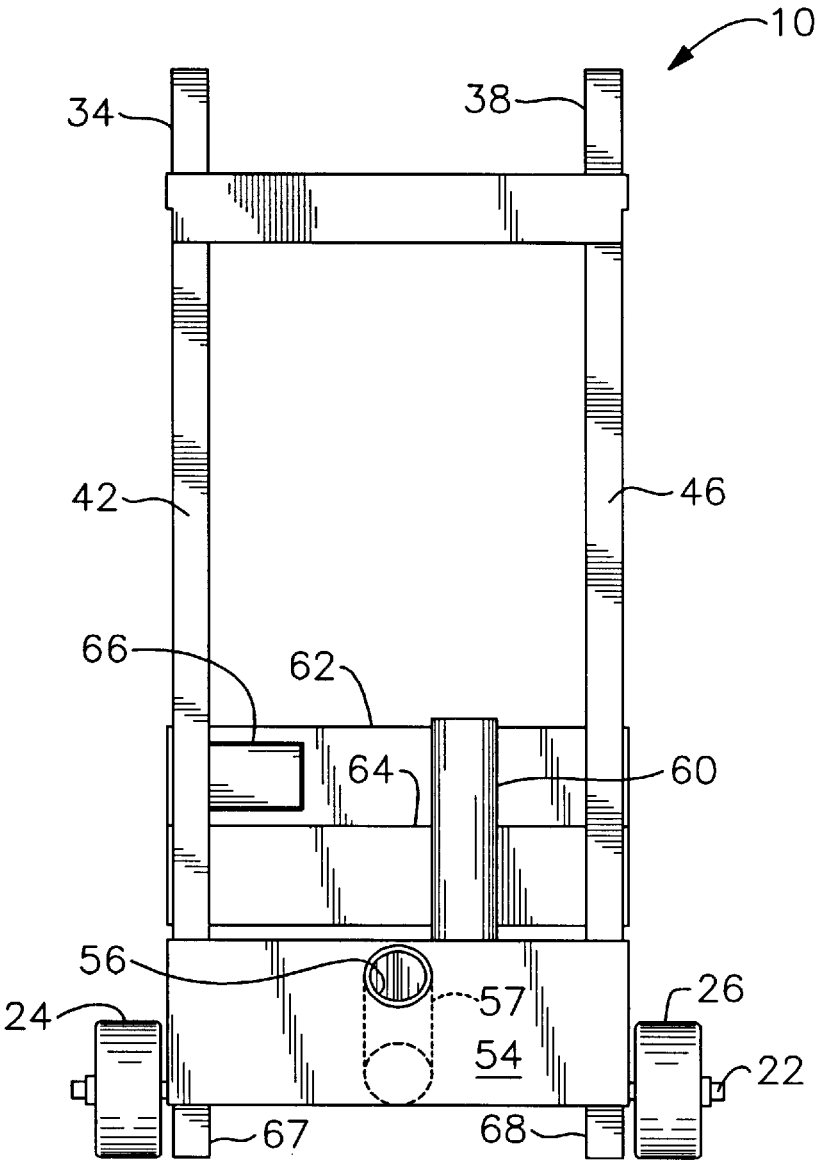
FIG. 1 is front elevational view of the novel stand.
Figure 2:
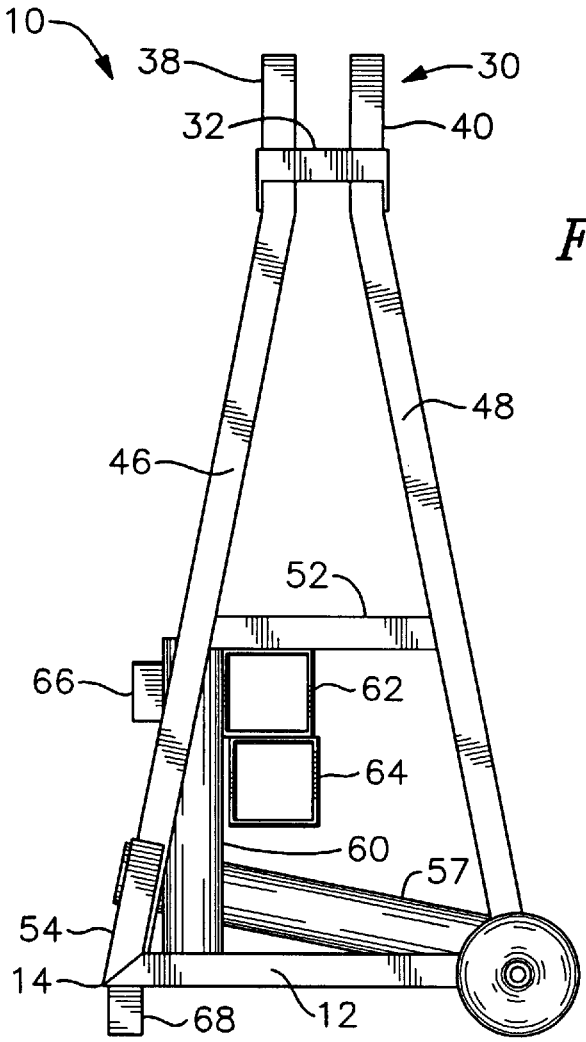
FIG. 2 is a side elevational view thereof.
Figure 3:
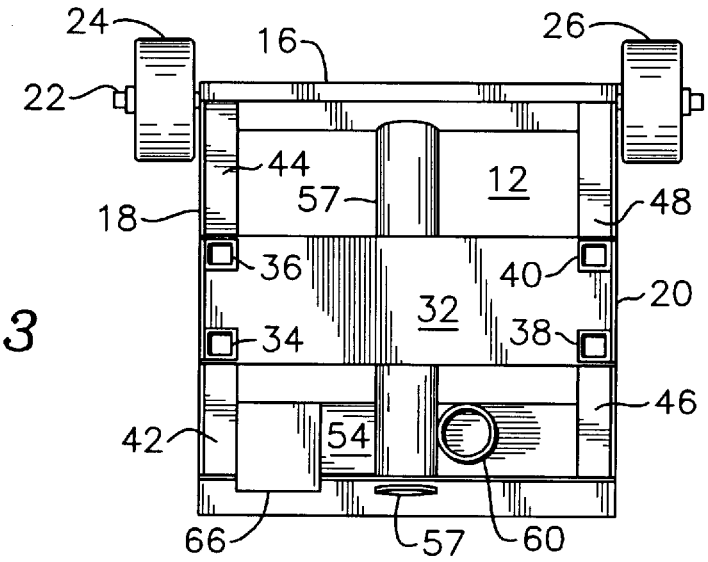
FIG. 3 is a top plan view thereof.

Referring now to FIGS. 1–3, it will there be seen that an exemplary embodiment of the invention is denoted as a whole by the reference numeral 10.

The base of novel light vehicle service stand 10 is a flat base plate 12 (FIG. 2) that is preferably of square configuration. Base plate 12 has a forward, transversely disposed edge 14, a rearward, transversely disposed edge 16, and longitudinally disposed, laterally spaced apart sides 18, 20. A transversely disposed axle 22 extends through a bore formed in rearward edge 16 of base plate 12 and wheels 24, 26 are rotatably mounted at opposite ends of said axle 22.

The vehicle-engaging end of the service stand 10 is a transversely disposed cradle means 30. It includes a bottom plate 32, a first pair of upstanding cradle arms 34, 36, and a second pair of cradle arms 38, 40, said first and second pair of cradle arms being disposed at opposite ends of cradle means 30.

Base plate 12 and cradle means 30 are interconnected to one another by a plurality of rigid legs. More particularly, cradle arms 34, 36 are the uppermost ends, respectively, of legs 42, 44 and cradle arms 38, 40 are the uppermost ends, respectively, of legs 46, 48. Legs 42, 44 are thus laterally disposed with respect to legs 46, 48. As best understood in connection with FIG. 2, legs 42, 44 diverge from one another from top to bottom, as do legs 46, 48, in view of the close spacing of their respective uppermost ends and the relatively wide spacing of their respective lowermost ends.

Longitudinally disposed first brace 50 interconnects legs 42, 44 approximately mid-length thereof and longitudinally disposed second brace 52 interconnects legs 46, 48 approximately mid-length thereof as well.

Handle-engaging plate 54 extends transversely between legs 42, 46. Aperture 56 is formed therein to accommodate the forward end of elongate, longitudinally disposed, handle-receiving tube 57; the rearward end of said tube 57 is secured to base plate 12.

Figure 4:
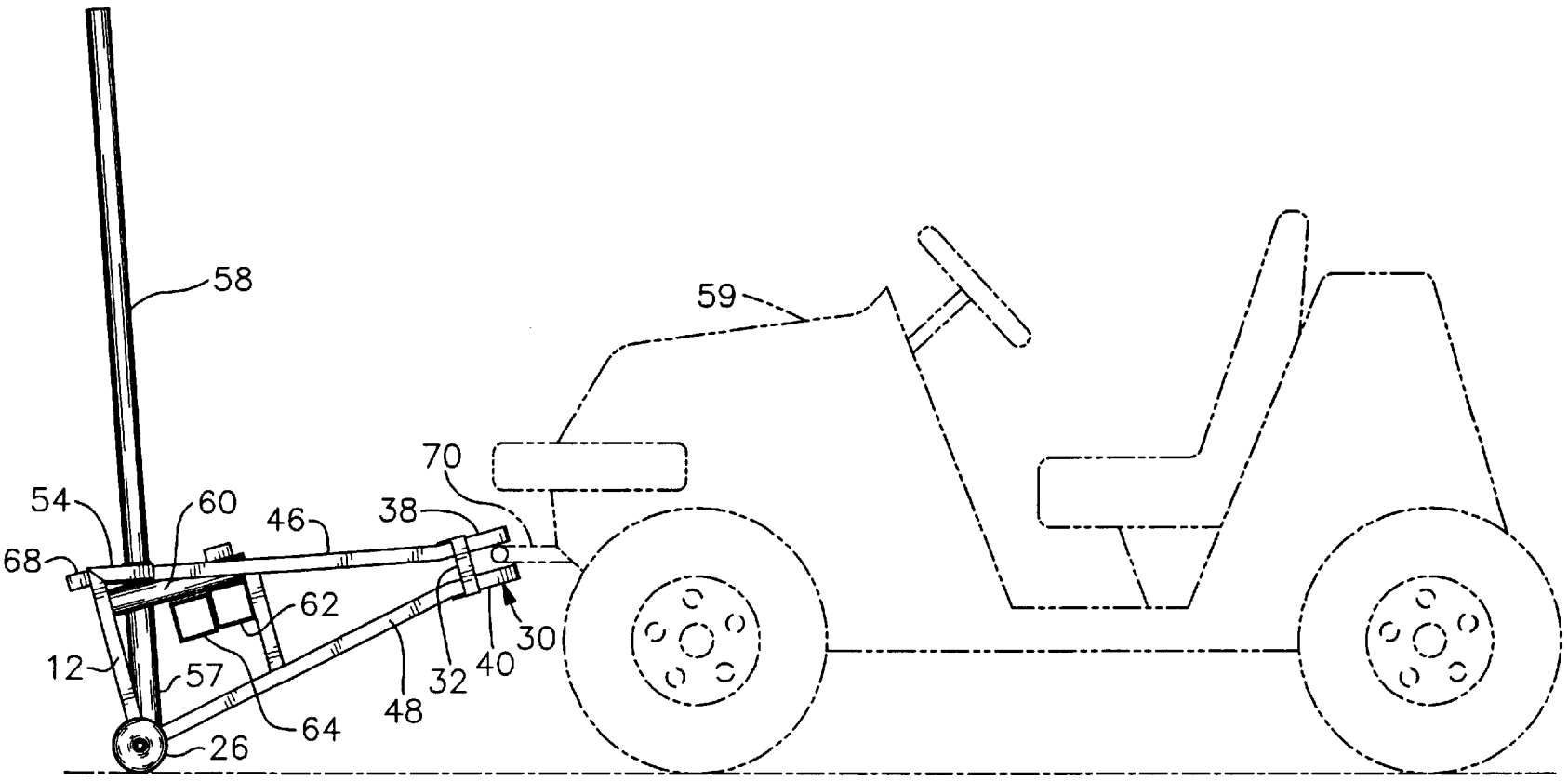
FIG. 4 is a side elevational view depicting the initial engagement of the novel cradle means and a lifting bar.

As best understood in connection with FIG. 4, leading end 59 of elongate leverage handle 58 is slidingly inserted into tube 57 when said handle is used to provide leverage in lifting the front or rear end of a light vehicle 59. Tube 57 is disposed at about a fifteen degree angle relative to a horizontal plane when stand 10 is in its upright position as depicted in FIG. 2.

Figure 6:
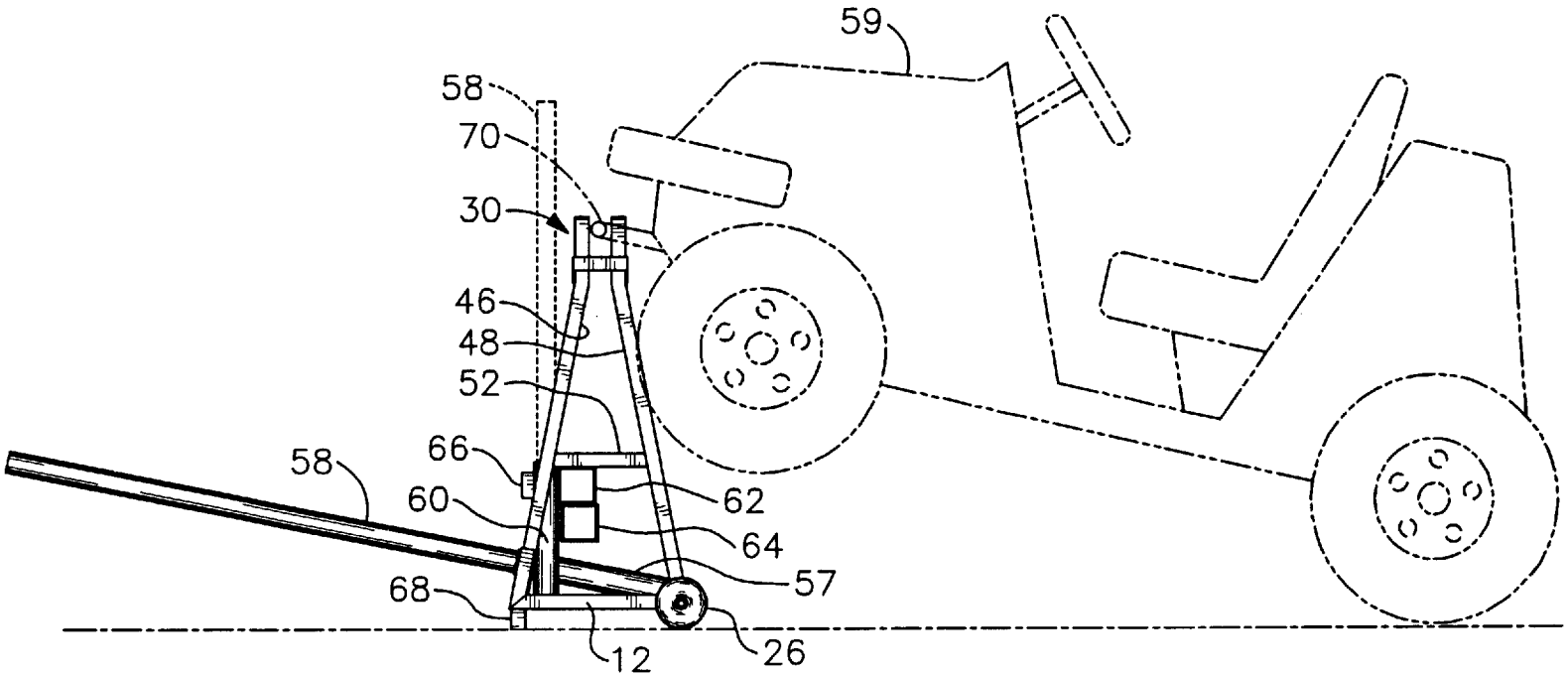
FIG. 6 is a side elevational view when said preselected end has been fully lifted.

When not in use, handle 58 is advantageously stored in an upstanding, hollow receptacle 60 (FIGS. 1–3) having its lowermost end recessed within or otherwise secured to base plate 12. FIG. 6 depicts handle 58 in phantom lines to indicate its position when stored in receptacle 60.

A similar pair of hollow receptacles, denoted 62, 64, (see FIGS. 1 and 2) are horizontally deployed. Advantageously, a transversely disposed uppermost or first receptacle 62 may be fixedly secured to respective undersides of braces 50, 52, in interconnecting relation therewith, and a transversely disposed lowermost or second receptacle 64 may be fixedly secured to said uppermost receptacle 62 in depending relation thereto. These transversely disposed receptacles may be used to store new blades so that they are within reach when the old blades have been removed. The old blades may then be stored in such receptacles after they have been removed.

Still another receptacle, denoted 66, is preferably secured to leg 42; it defines an enclosure into which a lubrication gun, not shown, or other implement may be inserted for storage; this ensures that a lubrication gun or other tool will be available within easy reach when needed.

Support legs 67, 68, which depend from the forward edge 14 of base plate 12, have a length substantially equal to the radius of wheels 24, 26 so that base plate 12 is substantially level when novel service stand 10 is positioned on a level support surface.

Figure 5:
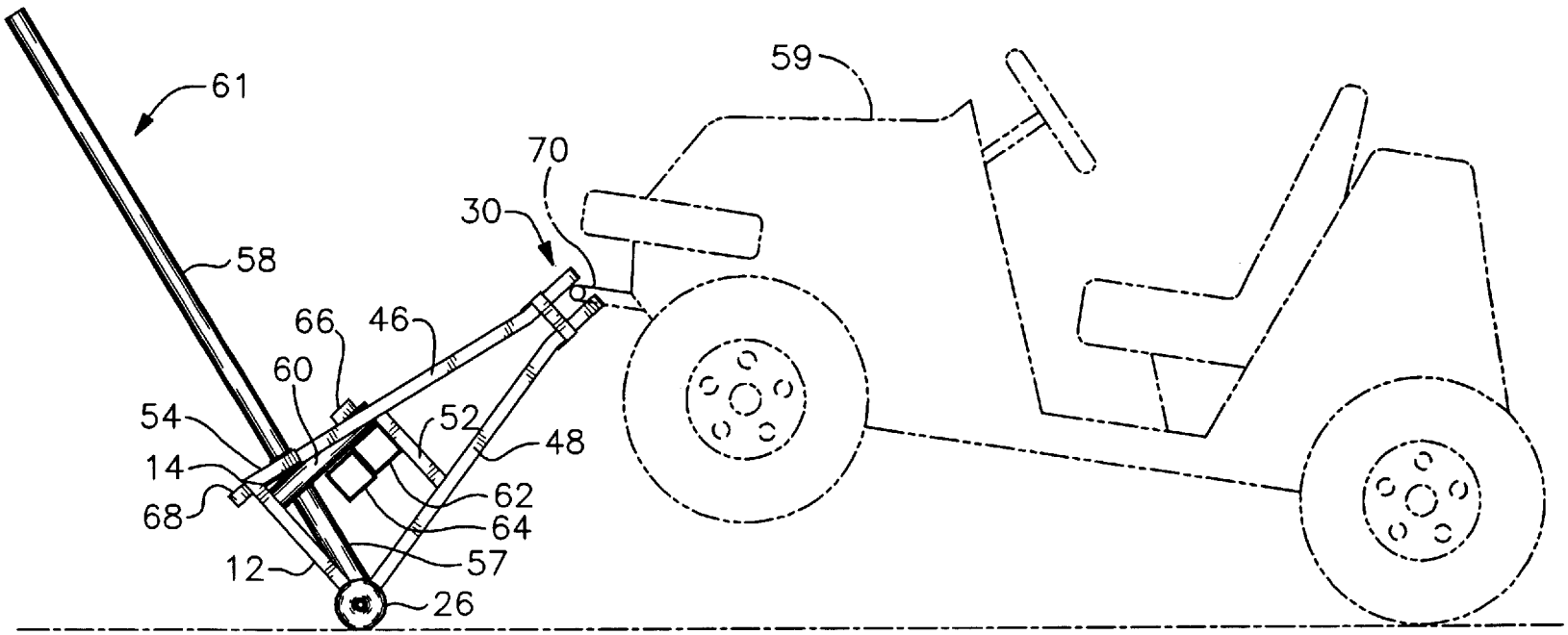
FIG. 5 is a side elevational view depicting the respective positions of the novel stand and a mower when a preselected end of the mower is about half lifted.

The steps required to lift the front or rear end of a mower or other light vehicle are depicted in FIGS. 4–6. Rigid lifting bar 70 which is cradled by novel cradle means 30 is provided as original equipment by some light vehicle manufacturers; it is usually on the front end of a mower or cart. For mowers, carts, or similar light vehicles lacking such a lifting bar, one may be added to the front or rear thereof, or both, so that the novel device may be used to lift either the front or rear end thereof. In mower applications, blade changing is easiest when the front end of a mower is lifted, but motor and drive train maintenance are best performed with the rear end lifted.

Since different mower and cart manufacturers make mowers and carts of differing shapes and features, lifting bar 70 may differ in structure from vehicle to vehicle, and the exact form of the novel cradle means 30 may need to be adapted as well to fit such bars.

Novel stand 10 is first tilted as depicted in FIG. 4 so that cradle means 30 engages the front or rear lifting bar 70 of a light vehicle. Support legs 67, 68 thus disengage from the floor but wheels 24, 26 remain in contact therewith.

The individual operating novel stand 10 then pulls handle 58 in the direction indicated by directional arrow 61 in FIG. 5 while placing a foot on leading edge 14 of base plate 12. Wheels 24, 26 thus roll toward the vehicle being lifted until support legs 67, 68 are lowered into overlying relation to the floor, and the lifting is completed; see FIG. 6. Handle 58 is then returned to its receptacle 60 so that no one will trip over it. When the maintenance procedures are completed, the leading end of handle 58 is inserted into handle-receiving tube 57, and the lifting procedure is reversed to lower the vehicle. Thus, FIG. 5 may also be understood as depicting the vehicle being lowered from its FIG. 6 position.

The length of handle 58 provides ample leverage and as a result the user of novel stand 10 need not use much strength. The stand is of rigid construction so that there is no danger of collapse once the vehicle has been lifted. Since stand 10 can lift the front or rear end of any light vehicle equipped or retrofitted with a lifting bar, it is very useful and will increase productivity in the commercial mower, golf cart, and related light vehicle industries.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A commercial mower or other light vehicle service stand, comprising:

a cradle means adapted to cradle a lifting bar fixedly secured to a preselected end of a light vehicle;

a base member disposed in vertically spaced relation to said cradle means;

a first pair of rigid leg members disposed in interconnecting relation between a first end of said cradle means and a first end of said base means;

a second pair of rigid leg members disposed in interconnecting relation between a second end of said cradle means and a second end of said base means;

said first and second pair of rigid leg members being laterally disposed with respect to one another;

said base member having a forward edge, a rearward edge, and a pair of laterally spaced apart sides;

an axle means mounted to said rearward edge of said base member;

a wheel means including a wheel rotatably mounted to each end of said axle means;

an elongate handle formed independently of said service stand;

a handle-engaging means mounted to said service stand; and said handle-engaging means including a transversely disposed rigid plate secured to said first and second pairs of rigid leg members in interconnecting relation therewith, an aperture formed in said rigid plate, and a longitudinally disposed handle-receiving tube having a forward end disposed in registration with said aperture and a rearward end secured to said base plate;

whereby a preselected end of a light vehicle is lifted by first engaging said lifting bar with said cradle means with said wheel means in rotatable engagement with a support surface and with said base means being disposed substantially vertically with respect to said support surface, and next by bringing said base into substantially parallel relation to said support surface by manually pulling down on a free end of said elongate handle and advancing said wheel means under said light vehicle while said elongate handle is engaged to said handle-engaging means.

2. The service stand of claim 1, further comprising a longitudinally disposed first brace positioned in bracing relation to said leg members of said first pair of leg members and a longitudinally disposed second brace positioned in bracing relation to said leg members of said second pair of leg members.

3. The service stand of claim 2, further comprising a transversely disposed hollow receptacle secured in interconnecting relation between said first brace and said second brace, said first hollow receptacle adapted to receive a lawnmower blade therein.

4. The service stand of claim 3, further comprising a second transversely disposed hollow receptacle secured in depending relation to said first transversely disposed hollow receptacle, said second hollow receptacle adapted to receive a lawnmower blade therein.

5. The service stand of claim 1, further comprising an enclosure secured to a preselected leg member of said first and second pairs of leg members, said enclosure adapted to releasably hold a tool such as a lubrication gun.

6. The service stand of claim 1, further comprising a pair of support legs secured in depending relation to said forward edge of said base plate, said support legs having a common length substantially equal to a radius of said wheel means so that said base plate is substantially parallel to said support surface when said support legs are in contact with said support surface.

7. The stand of claim 6, wherein said handle-receiving tube is inclined at an angle of about fifteen degrees relative to a horizontal plane when said support legs and said wheel means are in contact with said support surface.

8. The stand of claim 1, further comprising a hollow receptacle secured in upstanding relation to said base plate, said hollow receptacle receiving said elongate handle when said elongate handle is not received within said handle-receiving tube.

* * * * *